US007503435B2

(12) United States Patent
Tyni et al.

(10) Patent No.: US 7,503,435 B2
(45) Date of Patent: Mar. 17, 2009

(54) ELEVATOR SAFETY CIRCUIT MONITORING SYSTEM AND METHOD

(75) Inventors: Tapio Tyni, Hyvinkää (FI); Pekka Perälä, Kerava (FI)

(73) Assignee: KONE Corporation, Helsinki (FI)

( * ) Notice: Subject to any disclaimer, the term of this patent is extended or adjusted under 35 U.S.C. 154(b) by 0 days.

(21) Appl. No.: 11/898,793

(22) Filed: Sep. 14, 2007

(65) Prior Publication Data

US 2008/0060883 A1 Mar. 13, 2008

Related U.S. Application Data

(63) Continuation of application No. PCT/FI2006/000084, filed on Mar. 10, 2006.

(30) Foreign Application Priority Data

Apr. 8, 2005 (FI) ..... 20050361

(51) Int. Cl.
*B66B 1/34* (2006.01)

(52) U.S. Cl. ..... 187/391

(58) Field of Classification Search ..... 187/247, 187/391–394; 49/26, 28, 120
See application file for complete search history.

(56) References Cited

U.S. PATENT DOCUMENTS 3,854,554 A * 12/1974 Booker, Jr. ..... 187/382
4,157,133 A * 6/1979 Corcoran et al. ..... 187/384
4,162,719 A * 7/1979 Husson et al. ..... 187/382
4,284,175 A * 8/1981 Ishii et al. ..... 187/289
4,898,263 A 2/1990 Manske et al.
5,487,448 A 1/1996 Schollkopf et al.
6,056,088 A 5/2000 Gerstenkorn
6,193,019 B1 2/2001 Sirigu et al.
6,446,760 B1 * 9/2002 Lisi ..... 187/391

FOREIGN PATENT DOCUMENTS

EP 0149727 A1 7/1985
JP 7-274268 A 10/1995

* cited by examiner

*Primary Examiner*—Jonathan Salata
(74) *Attorney, Agent, or Firm*—Birch, Stewart, Kolasch & Birch, LLP

(57) ABSTRACT

The invention concerns a method and a system for monitoring the operation of the safety circuit of an elevator, said safety circuit containing safety switches connected in series with a contactor and a static circuit. In the method, the current flowing in the safety circuit is measured and the state of the safety circuit is determined on the basis of the measured current. The measurement of the safety circuit current is preferably performed without a galvanic connection to the safety circuit. The state of the safety circuit is determined on the basis of the magnitude of the measured current, from which the positions of the safety switches during the current measurement can be inferred.

Figure 1:
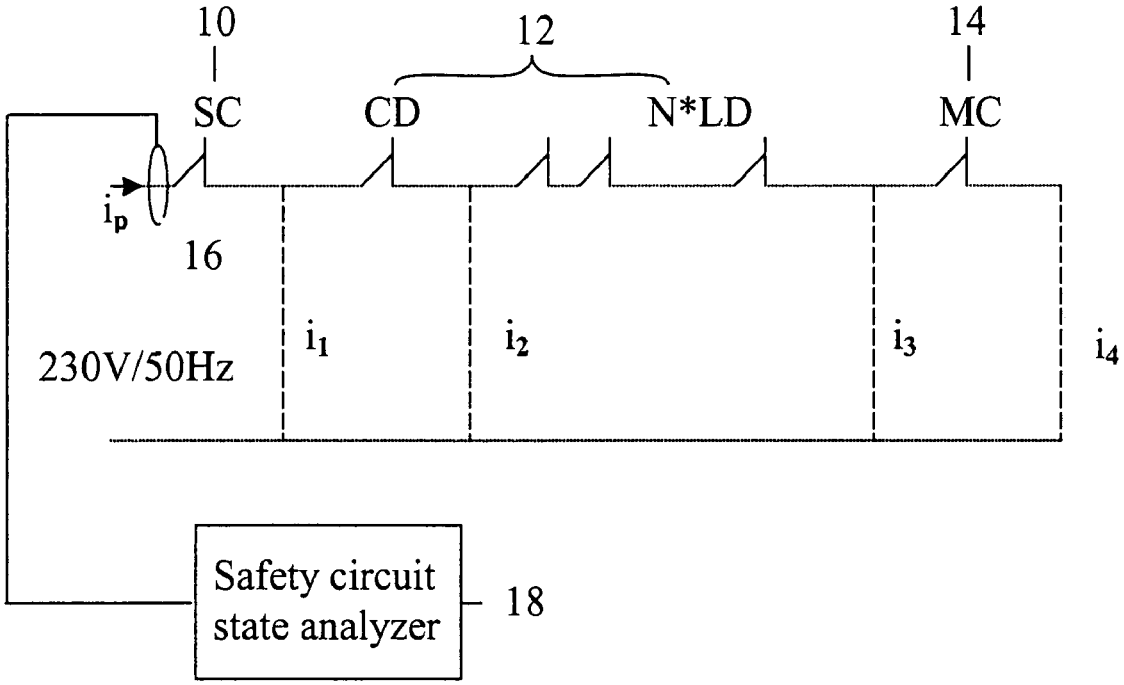

8 Claims, 8 Drawing Sheets u/V
5
0
-5
t/s
0
10
20
30
40
50
60
70
80
90
100
110 i/A
0.05
0
-0.05
t/s
0
10
20
30
40
50
60
70
80
90
100
110 i/A
0.05
0
-0.05
t/s
0
10
20
30
40
50
60
70
80
90
100
110

ELEVATOR SAFETY CIRCUIT MONITORING SYSTEM AND METHOD

This application is a Continuation of copending PCT International Application No.

PCT/FI2006/000084 filed on Mar. 10, 2006, which designated the United States, and on which priority is claimed under 35 U.S.C. §120. This application also claims priority under 35 U.S.C. § 119(a) on Patent Application No(s). 20050361 filed in Finland on Apr. 8, 2005. The entire contents of each of the above documents is hereby incorporated by reference.

FIELD OF THE INVENTION

The present invention relates to elevator systems. In particular, the present invention concerns a method and a system for monitoring the operation of a safety circuit in elevator systems.

BACKGROUND OF THE INVENTION

It is of primary importance for the operation of an elevator system that the system should work correctly and above all safely.

For this reason, elevator systems employ a number of different safety devices. One of these is the so-called safety circuit. The safety circuit is the most important part of the electric safety system of an elevator. The safety circuit extends in the elevator shaft from one safety device to another. The circuit typically consists of safety device contacts and switches chained in series. If any one of the safety devices interrupts the safety circuit, the elevator will stop or will not start moving. The safety circuit monitors e.g. the car doors, landing doors, locks, etc. For example, if the doors of the elevator car are open, then the safety circuit is open and the elevator should not start moving under any circumstances.

An elevator in use must be maintained and its condition must be statutorily checked to guarantee its safe operation. To check the condition of an elevator, it is subjected to operation tests, in other words, the operation of the safety and alarm equipment is tested and checks are carried out to make sure that the elevator does not move before the car and landing doors are closed and that the doors do not open before the elevator is at a floor. In the condition monitoring inspection, it is possible to use various condition monitoring equipments, including analyzers that can utilize information regarding the current flowing in the safety circuit.

It is thus possible to make inferences about the condition of the elevator by observing the operation of the safety circuit. Based on the intensity of the current flowing in different parts of the safety circuit, it is possible to infer which ones of the switches comprised in the safety circuit are closed at each instant of time and whether the elevator is functioning in accordance with the regulations imposed on it.

However, measuring the current from intermediate taps of the safety circuit is problematic because there are regulatory restrictions on the right to touch the safety circuit. Changes concerning the safety circuit must always be submitted to authorities for approval, which is why measuring the current of the safety circuit is in itself difficult. Moreover, it may be difficult to measure the current from different points of the safety circuit because the switches of different parts of the safety circuit are located in the elevator shaft at a considerable distance from each other in regard of measuring technics.

OBJECT OF THE INVENTION

The object of the present invention is to disclose a method and a system for monitoring the operation of the safety circuit of an elevator system.

BRIEF DESCRIPTION OF THE INVENTION

Inventive embodiments are presented in the description part and drawings of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

The invention concerns a method for monitoring the operation of a safety circuit, in which method the intensity of the current flowing in the safety circuit is measured and the state of the safety circuit is determined on the basis of the measured current.

In an embodiment of the invention, the intensity of the current flowing in the safety circuit is measured by means of a Hall current sensor galvanically separated from the safety circuit. The Hall current sensor measures the magnetic field generated by the current flowing in the safety circuit, and thus the safety circuit itself need not be touched at all in order to obtain a reliable measurement result. This obviates the need to make any galvanic connections or other difficult changes to the safety circuit. The Hall sensor can be connected to the safety circuit without interrupting the wiring of the safety circuit.

From the magnitude of the current flowing in the safety circuit, the position of the safety switches and the state of the safety circuit can be inferred with the help of a simple circuit diagram. The current measurement can be implemented by measuring from a single point. The measuring point is preferably located on the top of the elevator car, where also the rest of the condition monitoring equipment is placed in most cases. This makes it unnecessary to provide cables between the elevator car and the machine room.

In an embodiment of the invention, the state of the safety circuit at each instant of time is determined automatically on the basis of the measured current. In the automatic determination of the state, the measured current signal is processed before the determination. The current signal is preprocessed e.g. by filtering, rectifying or demodulating. After the preprocessing, reduction of samples is performed by converting the scales of the graph of the current signal into logarithmic form. For automatic classification of safety circuit states, e.g. a genetic algorithm is utilized, whereupon the state of the safety circuit at each instant of time is determined.

In a second embodiment of the invention, the amplitude spectrum of the measured safety circuit current is determined. From the amplitude spectrum it is possible to manually determine the limit values of the amplitude of the safety circuit current that are characteristic of each state of the safety circuit.

The invention also concerns a system for monitoring the operation of the safety circuit of an elevator, said safety circuit comprising safety switches connected in series with a contactor and a static circuit. The system further comprises measuring means for the measurement of the current flowing in the safety circuit. The system further comprises means for determining the state of the safety circuit on the basis of the measured current.

It is an objective of the invention is to measure the state of the safety circuit in such a way that no changes and no galvanic connections of any sort need to be made to the safety circuit. Thus, no extra load is imposed on the safety circuit. It is also an objective of the invention to define the state of the safety circuit for an analyzer estimating the condition of the elevator and forming an important part of the condition monitoring equipment of an elevator already in use. In this way it is possible to facilitate the monitoring of the condition of the elevator and to guarantee safe operation of the elevator.

The present invention has several advantages as compared to prior-art solutions. The invention makes it possible to determine the state of the safety circuit and the position of each safety switch. Based on different states of the safety circuit, it can be inferred whether the elevator is working in accordance with the requirements imposed on it as it is moving from floor to floor. The invention also provides reliable information as to whether the safety circuit is functioning in accordance with the requirements set on it.

By applying the procedure disclosed in the invention, a sufficient safety level of an elevator can be guaranteed by monitoring the state of the safety circuit without making any galvanic connections or other changes to the sensitive safety circuit. The system of the invention for monitoring the state of the safety circuit can also be easily installed as a retrofit on elevators already in use.

LIST OF FIGURES

Figure 2:
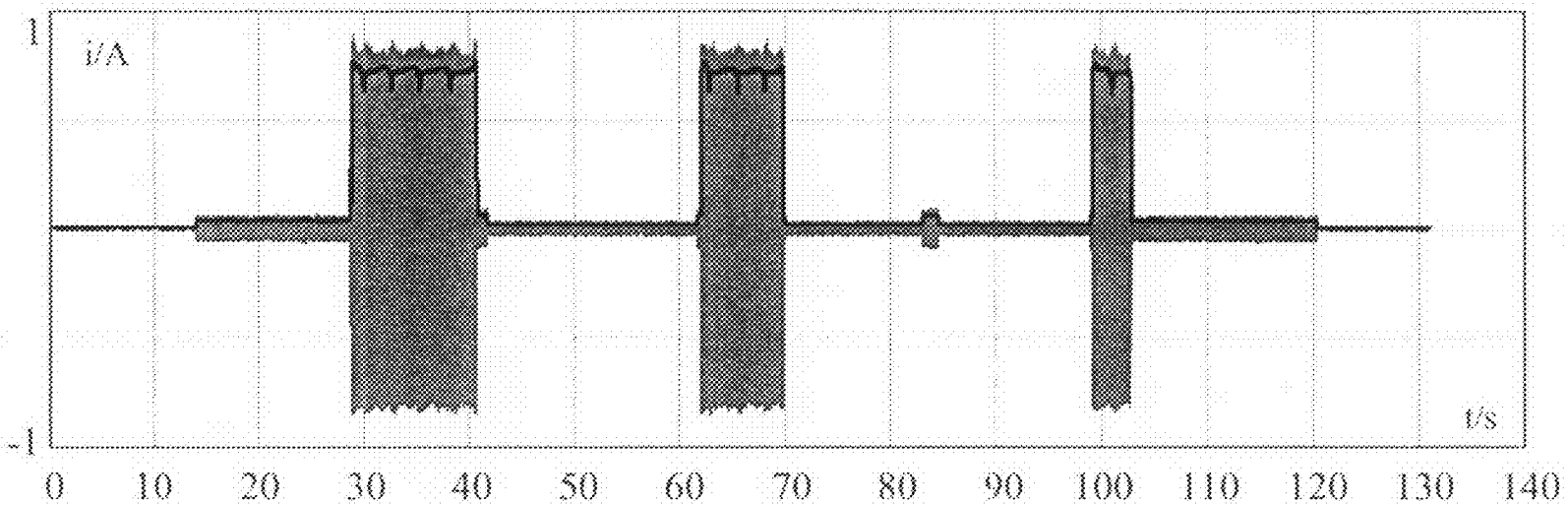
Figure 3:
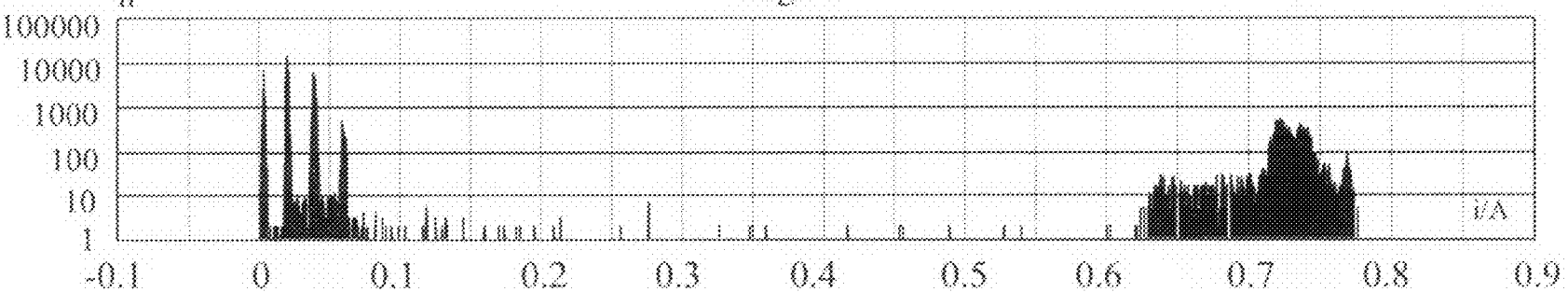
Figure 4:
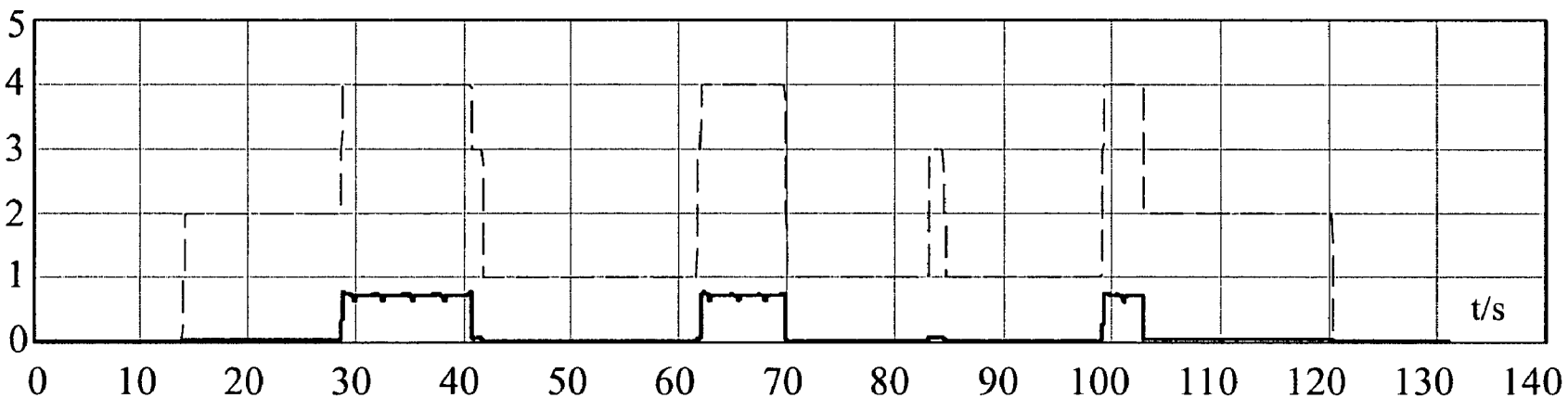
Figures 5A, 5B, 5C:
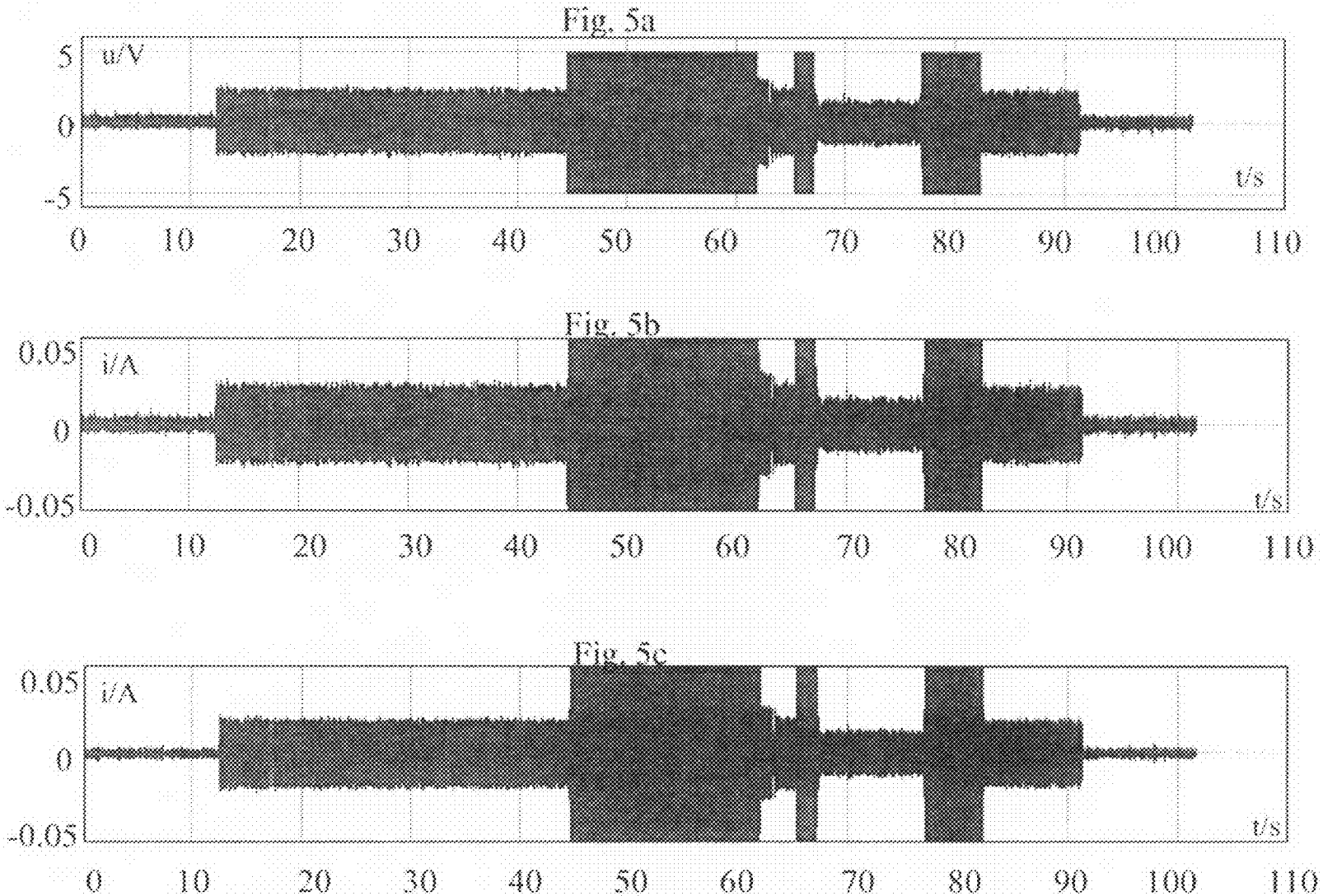
Figure 5D:
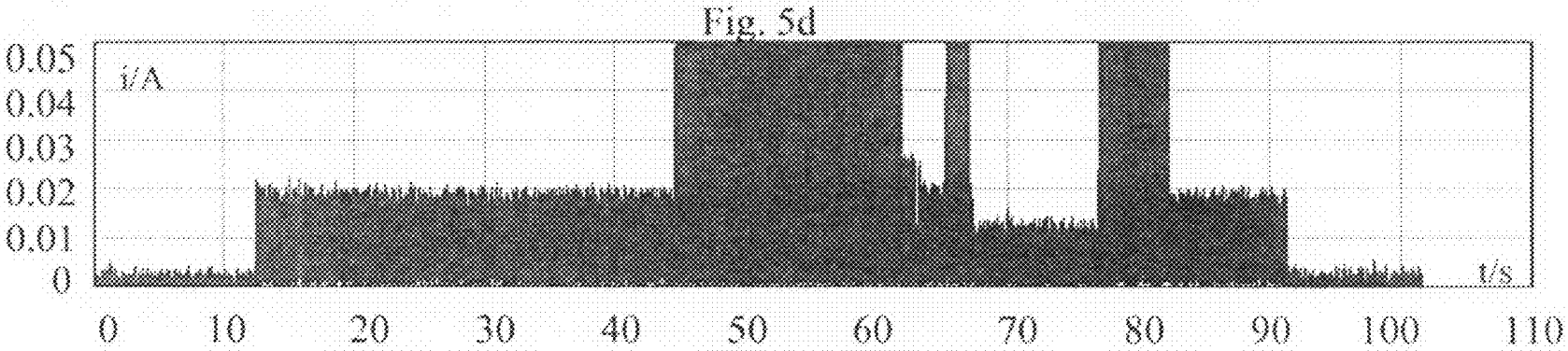
Figure 5E:
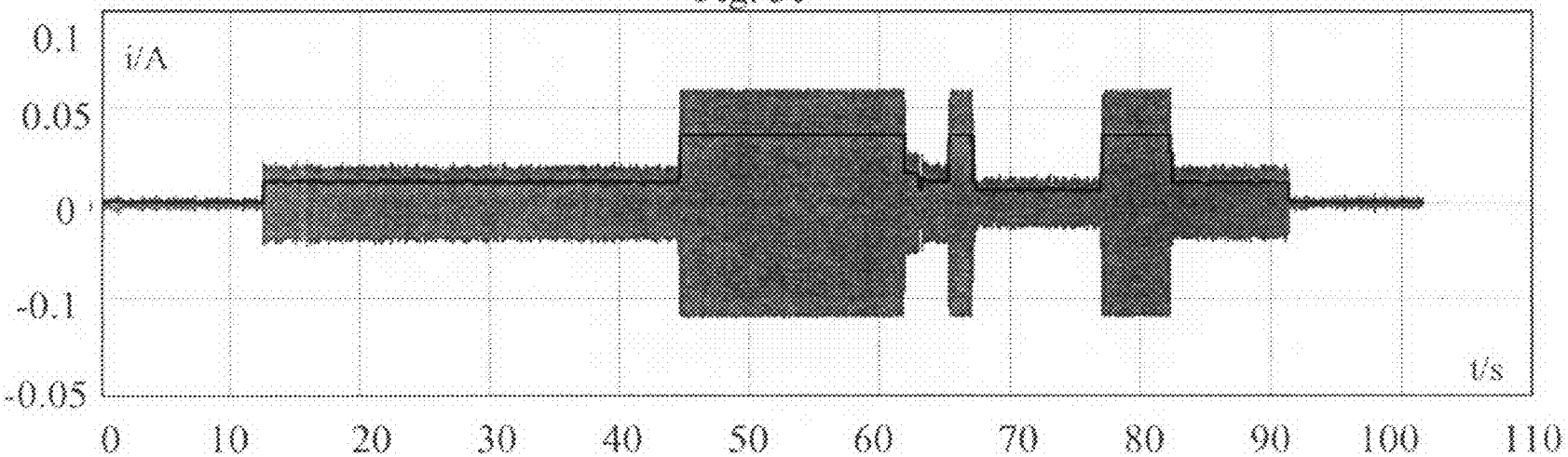
Figure 5F:
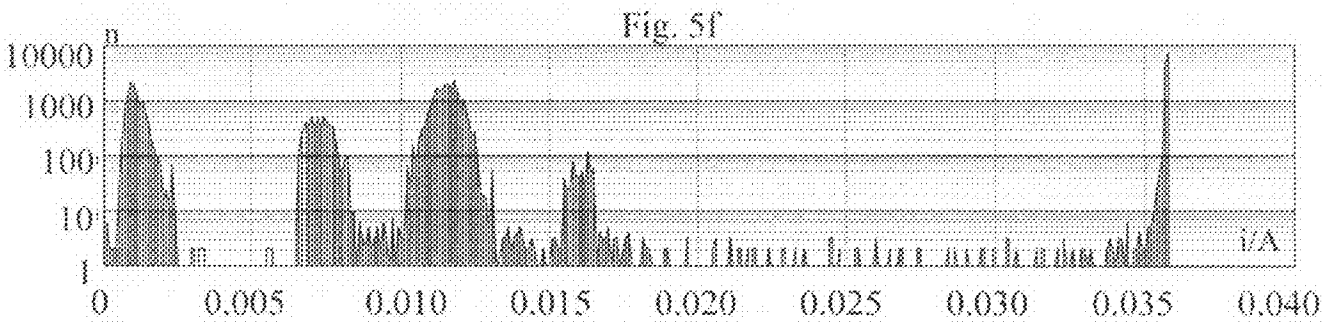
Figure 5G:
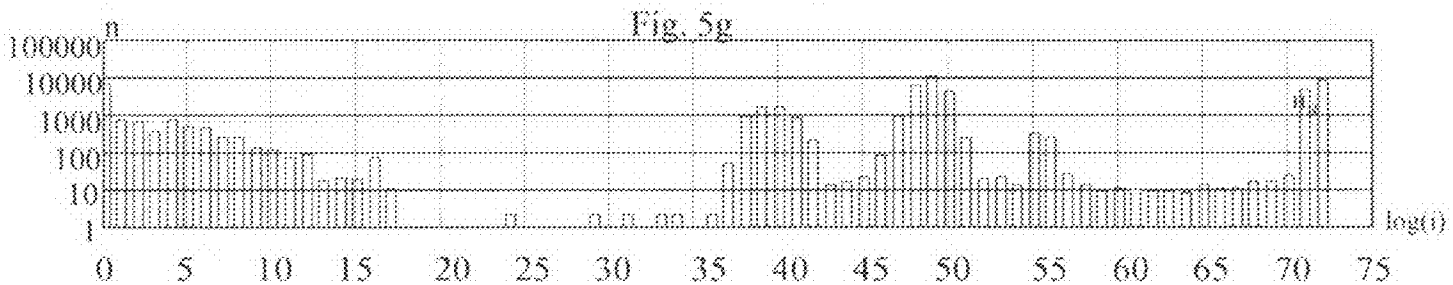
Figure 5H:
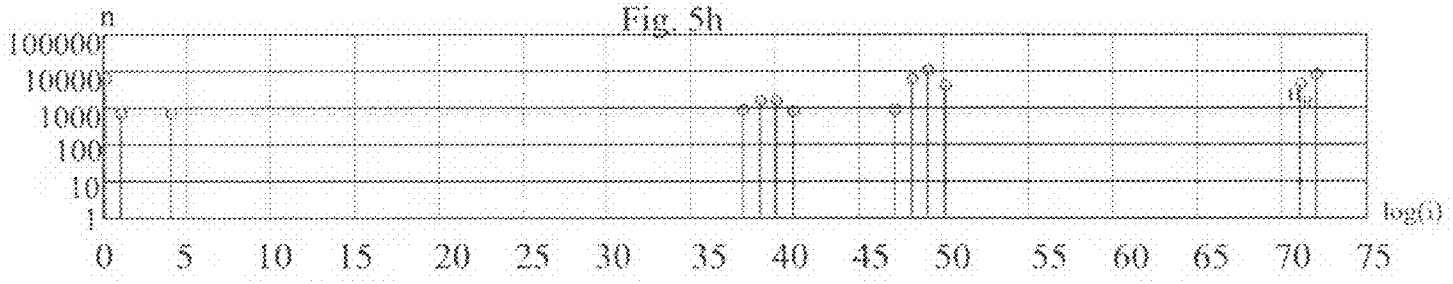
Figure 5I:
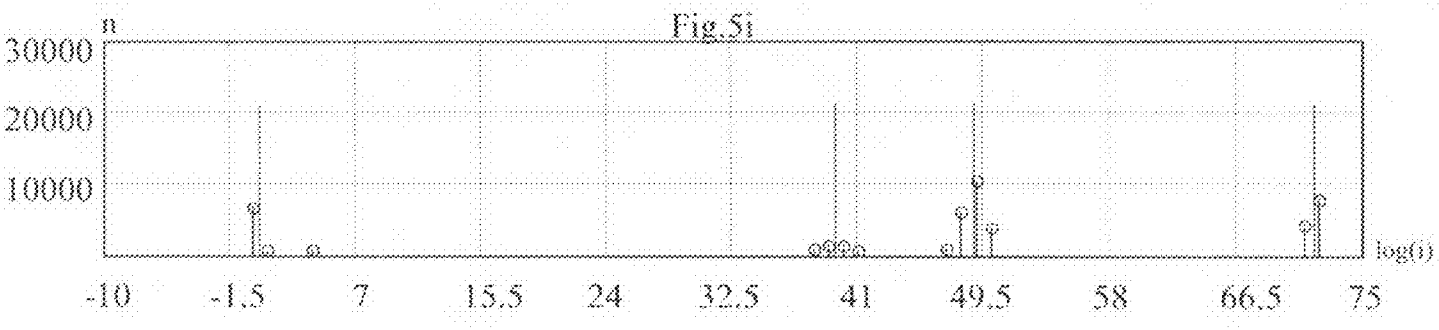
Figure 5J:
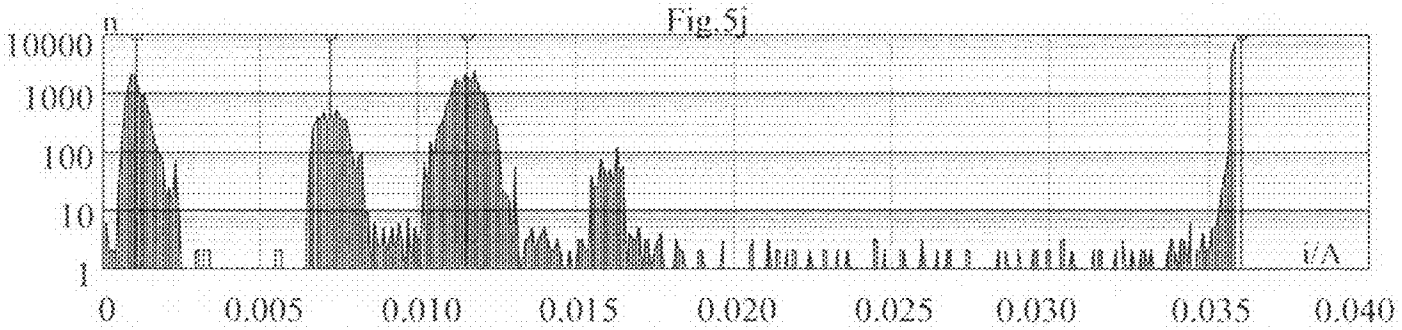
Figure 5K:
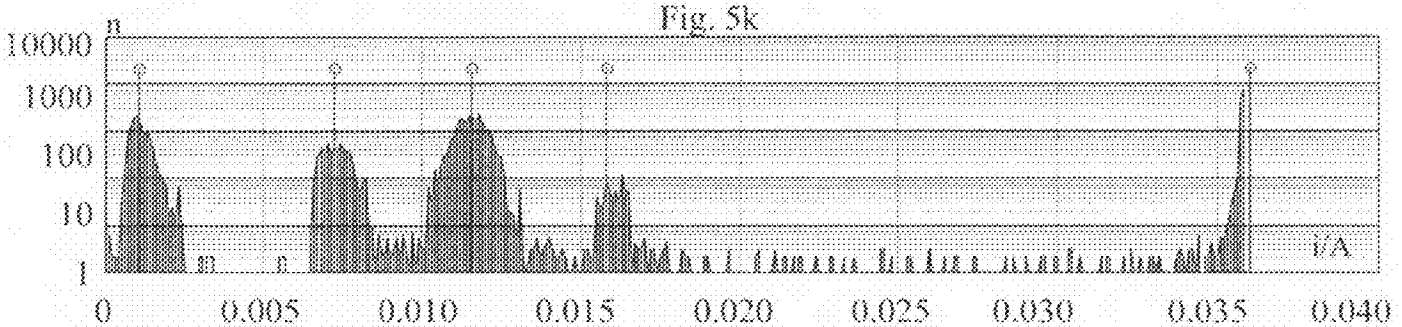
Figure 6:
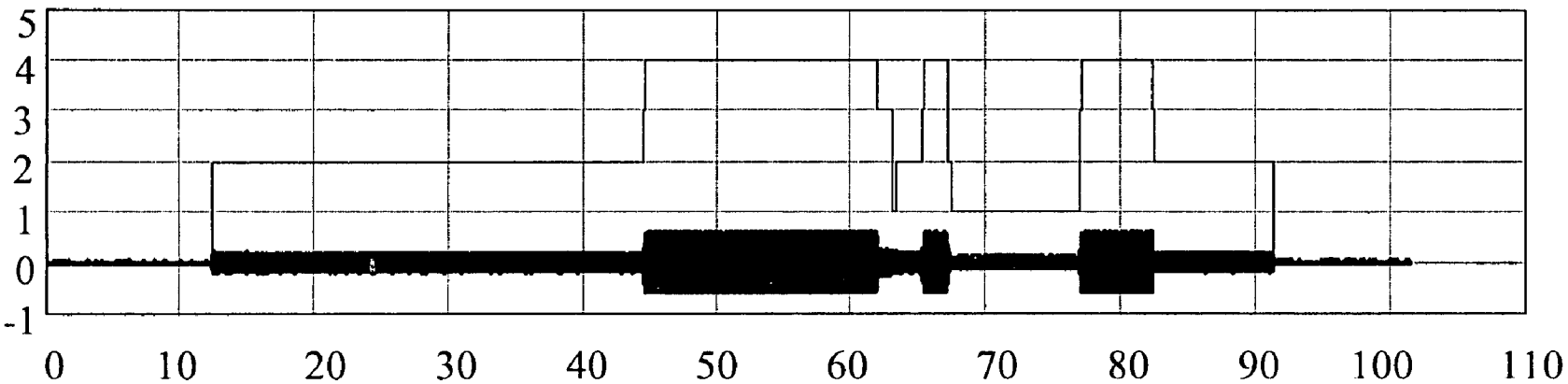

In the following, the invention will be described in detail with reference to embodiment examples, wherein:

FIG. 1 presents a elevator safety circuit, showing the current flowing in it and the safety switches of the safety circuit, FIG. 2 represents the 50-Hz current flowing in the safety circuit during three trips of the elevator from one floor to another, FIG. 3 presents an amplitude spectrum of the safety circuit current, FIG. 4 represents the measured safety circuit current and the safety circuit state corresponding to it as a function of time, FIGS. 5*a*-5*k* represent different stages of signal processing in automatic determination of safety circuit states, and FIG. 6 represents the measured current and the safety circuit state corresponding to it as a function of time.

DETAILED DESCRIPTION OF THE INVENTION

In the following, the invention will be described in detail with reference to FIGS. 1-4. FIG. 1 presents a safety circuit with the safety circuit currents $i_1$, $i_2$, $i_3$ and $i_4$ indicated according to the invention at different points in the circuit.

In the safety circuit presented in FIG. 1, SC 10 represents the static circuit of the safety circuit. Switch CD 12 represents the car door switch, and switches N*LD 12 represent the landing door switches. The number of levels is N, depending on how many floors the elevator comprises. Switch MC 14 corresponds to the main contactor.

The total current $i_p$ at point p is obtained as follows:

$$i_p = SC \cdot i_1 + CD \cdot i_2 + i_3 \cdot \prod_{k=1}^{N} LD_k + MC \cdot i_4,$$

where switches SC, CD, LD and MC get the value of 0 or 1.

From the magnitude of the total current, the state of the safety circuit at each instant of time can be unambiguously deduced. The possible states of the safety circuit are defined in Table 1 below:

TABLE 1

| Safety circuit current at point p | State of switches | Operational state of safety circuit |
|---|---|---|
| i = 0 | SC = 0 | static circuit is open |
| i = i1 | SC = 1 | static circuit is closed |
| i = i1 + i2 | SC = 1, CD = 1 | car door is closed |
| i = i1 + i3 | SC = 1, LD = 1 | landing door is closed |
| i = i1 + i2 + i3 | SC = 1, CD = 1, LD = 1 | car and landing doors are closed |
| i = i1 + i2 + i3 + i4 | SC = 1, CD = 1, LD = 1, MC = 1 | main contactor is closed |

The safety circuit can thus be in one of six different states, which can be distinguished from each other on the basis of the magnitude of the current flowing at point p. However, often the intermediate taps in the safety circuit for the currents $i_1$, $i_2$ and $i_3$ are equal, i.e. $i_1=i_2=i_3$. In this case, the car door and the landing door can not be distinguished from each other and the number of possible state combinations for the safety circuit is five.

At point p, some of the safety circuit conductor is wound e.g. around a current sensor 16. The sensor 16 measures the magnetic field generated by the current flowing in the safety circuit conductor wound around it. Thus, the measurement of the safety circuit current does not impose a load on the electric safety circuit in any situation, in other words, no energy is taken from the safety circuit.

In FIG. 2, a current measured by a current sensor at point p in the elevator system is presented as a function of time. The envelope curve shown in FIG. 2 corresponds to 50-Hz safety circuit current and the continuous line corresponds to the absolute value of the current. The elevator performs three trips and one re-opening of the doors. At instant 1-12 s, the static circuit has been open and the current flowing in the safety circuit is 0 A. At instant t=12 *s*, the static circuit switch SC has been closed (SC=1), but the landing and car doors are open. At instant t=29 *s*, the doors close and the elevator starts moving towards the desired floor. At instant t=41 *s*, the elevator stops at a floor and at instant t=61 *s*it starts moving again, to stop again at instant t=70 *s*. At instant t=83 *s*, the doors are re-opened, the car and landing doors being held open for a short time. During the interval t=99-102 *s*, the elevator is moving again. At instant t=120 *s*, the static circuit is opened, whereupon the safety circuit current falls to zero again.

FIG. 3 presents the amplitude spectrum of the absolute value of the current flowing in the safety circuit. The amplitude spectrum reveals five different clusters, on the basis of which it is possible to set the limit values for different states of the safety circuit. In this case, there are only five safety circuit states because the currents at the car door and landing door tapping points are equal and cannot be distinguished from each other. From the figure one can see the following amplitude limits for different safety circuit states: 0.01 A, 0.03 A, 0.05 A and 0.5 A. Table 2 below shows how the states are classified according to the current amplitude limits.

TABLE 2

| State of safety circuit | Functional state of safety circuit | Amplitude of current flowing in safety circuit |
|---|---|---|
| 0 | static circuit open | i < 0.01 A |
| 1 | static circuit closed | 0.01 A < i < 0.03 A |
| 2 | car door or landing door closed | 0.03 A < i < 0.05 A |
| 3 | car and landing doors closed | 0.05 A < i < 0.5 A |
| 4 | main contactors closed | i > 0.5 A |

The search for clusters in the amplitude spectrum of the safety circuit current and the determination of limit values for the safety circuit states can be automated so that it will be performed once in conjunction with the commissioning operation of the condition monitoring equipment. In this method no exact absolute values are needed for the current amplitude, but the distance between clusters is decisive. The peaks of the clusters and the distance between them determine the limit values characteristic of each safety circuit state.

FIG. 4 visualizes the relationship between the safety circuit current presented in FIG. 3 and the safety circuit state corresponding to it. The graph depicted with a solid line is the absolute value of the safety circuit current, while the graph drawn with a broken line represents the safety circuit state as classified by the parameters in Table 2.

FIGS. 5*a*-5*k* represent different stages of an automatic search for clusters and determination of limit values of safety circuit states. The diagram in 5*a* represents the voltage measured at point p by a current sensor, which voltage is preprocessed before the determination of the state. The voltage is scaled to form the actual current, which is presented as a function of time in FIG. 5*b*. After this, the current signal is filtered using e.g. a 50-Hz band-pass filter to remove noise (FIG. 5*c*) and rectified, in other words, the absolute value of the current is taken (FIG. 5*d*). The graph in FIG. 5*e* represents the original current signal modulated by the safety circuit states, while its envelope curve represents the filtered current signal. In FIG. 5*f*, the current signal has been converted to a logarithmic scale with the x-axis representing the current and the y-axis representing the number of samples, i.e. indicating how many samples of each current value have been obtained.

However, since not necessarily all states are visible on the current scale, the current scale itself is converted into logarithmic form (FIG. 5*g*). This makes it possible to reduce the number of samples on the x-axis, as can be seen from the histogram in FIG. 5*g*. The average value of the envelope curve of the signal in FIG. 5*b* is calculated, and samples below the average are left out when the states are being determined (FIG. 5*h*). The system performing the signal processing has been given input information regarding the number of existing states (e.g. four states), on the basis of which the system defines four alternative states (FIG. 5*i*). The clustering of samples can be accomplished by using a genetic algorithm, whereupon the signal is modified by converting it again into the number of samples on the current scale (FIG. 5*j*). A missing cluster has been added afterwards to the graph in FIG. 5*k* by a mathematical method by adding to the latest cluster the difference between the two preceding clusters.

FIG. 6 presents the automatically obtained safety circuit states together with the measured current signal. As the course of the maintenance-mode operation of the elevator, i.e. e.g. the times when the doors have been open or closed are known, by observing the states of the safety circuit it is possible to infer whether the elevator is working in the expected manner.

The invention is not exclusively limited to the embodiment examples described above; instead, many variations are possible within the scope of the inventive concept defined in the claims.

The invention claimed is:

1. A method for monitoring the operation of the safety circuit of an elevator, said safety circuit containing safety switches connected in series with a contactor and a static circuit the method comprising:

measuring the current flowing in the safety circuit;

determining the state of the safety circuit on the basis of the measured current;

wherein the state of the safety circuit is determined automatically;

wherein the automatic determination of the state of the safety circuit includes:

pre-processing the current signal;

performing a reduction of samples; and classifying the states.

2. A method according to claim 1, wherein:

the current flowing in the safety circuit is measured by means of a current sensor measuring the intensity of the magnetic field.

3. A method according to claim 1, wherein the current sensor is connected to the safety circuit without interrupting the safety circuit wiring.

4. A method for monitoring the operation of the safety circuit of an elevator, said safety circuit containing safety switches connected in series with a contactor and a static circuit the method comprising:

measuring the current flowing in the safety circuit; and determining the state of the safety circuit on the basis of the measured current;

wherein the state of the safety circuit is determined manually;

wherein the manual determination of the state of the safety circuit includes:

determining the amplitude spectrum of the measured current; and determining from the amplitude spectrum the limit values of the amplitude of the safety circuit current that are characteristic of each state.

5. A system for monitoring the operation of the safety circuit of an elevator, said safety circuit containing safety switches connected in series with a contactor and a static circuit:

the system comprising:

measuring means for measuring the safety circuit current;

means for determining the state of the safety circuit on the basis of the measured current; and means for pre-processing of the current signal, reduction of samples and classification of states.

6. A system according to claim 5, wherein the means for measuring the safety circuit current comprise a current sensor measuring the intensity of the magnetic field.

7. A system according to claim 5, wherein the current sensor is connected to the safety circuit without interrupting the safety circuit wiring.

8. A system for monitoring the operation of the safety circuit of an elevator, said safety circuit containing safety switches connected in series with a contactor and a static circuit:

the system comprising:

measuring means for measuring the safety circuit current;

means for determining the state of the safety circuit on the basis of the measured current;

wherein the system further comprises:

means for determining the amplitude spectrum of the measured current; and means for determining limit values characteristic of each state from the amplitude spectrum, said limit values being amplitudes of the safety circuit current.

* * * * *